US012317982B2

(12) United States Patent
Alexis

(10) Patent No.: US 12,317,982 B2
(45) Date of Patent: Jun. 3, 2025

(54) SYSTEMS AND METHODS FOR RETRACTABLE WHEELS

(71) Applicant: Arthur Antony Alexis, Leander, TX (US)

(72) Inventor: Arthur Antony Alexis, Leander, TX (US)

( * ) Notice: Subject to any disclaimer, the term of this patent is extended or adjusted under 35 U.S.C. 154(b) by 180 days.

(21) Appl. No.: 18/223,809

(22) Filed: Jul. 19, 2023

(65) Prior Publication Data

US 2024/0023685 A1 Jan. 25, 2024

Related U.S. Application Data

(60) Provisional application No. 63/390,776, filed on Jul. 20, 2022.

(51) Int. Cl.
*A45C 5/14* (2006.01)
*A45C 13/00* (2006.01)

(52) U.S. Cl.
CPC ..... *A45C 5/146* (2013.01); *A45C 13/001* (2013.01); *A45C 2200/20* (2013.01)

(58) Field of Classification Search
CPC ..... A45C 5/146; A45C 5/14; A45C 13/262
See application file for complete search history.

(56) References Cited

U.S. PATENT DOCUMENTS 1,808,864 A * 6/1931 Pinheiro ..... A45C 5/146 190/18 A
2,002,836 A * 5/1935 Rossi ..... A45C 5/146 280/80.1
2,925,283 A * 2/1960 Stilger ..... B62B 1/125 190/18 R
3,178,197 A * 4/1965 Boatner ..... A45C 13/262 280/37
3,917,038 A * 11/1975 Foge ..... A45C 5/146 D3/279
4,254,850 A * 3/1981 Knowles ..... A45C 5/146 D34/25
5,407,039 A * 4/1995 Alper ..... A45C 5/146 190/117
5,470,095 A * 11/1995 Bridges ..... A45C 5/146 280/DIG. 6
6,360,400 B1 * 3/2002 Chang ..... A45C 13/262 280/37
9,433,270 B2 * 9/2016 D'Angelo ..... A45C 13/262
9,636,557 B1 * 5/2017 Frank ..... A63B 55/30
9,700,110 B2 * 7/2017 Lee ..... A45C 13/262
2004/0000457 A1 * 1/2004 Sanford-Schwentke ..... A45C 5/146 280/655
2007/0278755 A1 * 12/2007 Jack ..... A47B 81/00 280/37
2013/0313795 A1 * 11/2013 Arthur ..... A45C 5/146 280/43.17

(Continued)

FOREIGN PATENT DOCUMENTS

CN 207444488 U * 6/2018
CN 210353544 U * 4/2020
CN 214112177 U * 9/2021

*Primary Examiner* — Nathan J Jenness
*Assistant Examiner* — Justin Caudill
(74) *Attorney, Agent, or Firm* — Pierson IP, PLLC

(57) ABSTRACT

Retractable wheels within a suitcase that are configured to be positioned within the suitcase responsive to applying a downward force on the suitcase.

10 Claims, 10 Drawing Sheets

(56) References Cited

U.S. PATENT DOCUMENTS

| | | | | |
|---|---|---|---|---|
| 2014/0238803 | A1* | 8/2014 | King | A45C 5/146 190/18 A |
| 2015/0208774 | A1* | 7/2015 | Leimenstoll | A45C 5/146 190/18 A |
| 2016/0235171 | A1* | 8/2016 | Barenbrug | A45C 5/146 |
| 2019/0000198 | A1* | 1/2019 | Wu | A45C 5/146 |
| 2020/0390208 | A1* | 12/2020 | Shah | A45C 5/146 |

* cited by examiner

SYSTEMS AND METHODS FOR RETRACTABLE WHEELS

BACKGROUND INFORMATION

Field of the Disclosure

Examples of the present disclosure are related to systems and methods for retractable wheels. More specifically, embodiments relate to retractable wheels within a suitcase with a gate and a lock. Responsive to moving the lock, the gate may rotate downward to allow a castor to automatically moves downward.

Background

The use of towable baggage has been prevalent, such as suitcases, backpacks, etc. with wheels. Conventionally, towable baggage includes permanently exposed wheels on the bottom of the baggage. However, situations may arise when the towable baggage needs to be stored, and the exposed wheels may occupy too much space. This led to towable baggage systems with wheels that have to be manually retracted or extended. Yet, this can become an arduous and time consuming task, especially when the towable baggage is storing fragile or heavy items.

Other towable baggage systems include complex systems of locks and springs to retract the wheels. These complex systems require substantial space within the towable baggage, which limits the amount of items that can be stored within the towable baggage.

Accordingly, needs exist for more effective and efficient systems and methods for a retractable wheel system configured to retract and extend wheels within towable baggage.

SUMMARY

Embodiments disclosed herein describe systems and methods for a retractable wheel system within towable baggage. The retractable wheel system may be configured to allow the wheels of the baggage to be retractable within the baggage by a user applying downward force against the baggage to compress a spring, and a locking pin on a shaft of the wheel traversing solenoid to position the wheel and the shaft within a housing. To position the wheel outside of the housing, the solenoid may be unlocked and the spring may automatically elongate to apply a force against an upper surface of the shaft to push the wheel outside of the housing. This system may minimize an amount of space occupied by the wheel while stored within the towable baggage, while selectively locking the castor in place within the towable baggage.

The retractable wheel system may include a wheel, a shaft, spring, housing, and solenoid.

The wheel may be a castor that is configured to enable an object, such as towable baggage, to be moved. The wheel may be formed of various materials, shapes, and sizes. In a first mode of operation, the wheel may be configured to be positioned outside of the housing, and in a second mode of operation the wheel may be configured to be entirely positioned in the housing. The wheel may include a threaded tube, which is configured to be coupled with an inner circumference of the shaft. In embodiments, responsive to the shaft moving along a linear axis, the wheel may move along the linear axis. This may enable the wheel to be positioned outside of the housing in the first mode, and inside of the housing in the second mode.

The shaft may be tube, cylinder, projection, etc. having a first end coupled to the wheel, and a second end coupled to the spring. The shaft may be configured to translate forces applied by the spring to the wheel, which may enable the wheel to move from the first mode to a second mode. The shaft may include a locking pin. The locking pin may be a projection, outcrop, protrusion, etc. that is fixed on an outer circumference of the shaft, wherein the locking pin may be configured to extend in a plane orthogonal to a central axis of the shaft. In embodiments, responsive to the spring compressing a vertical offset between the locking pin and a proximal end of the housing may decrease. This may enable the locking pin to traverse the solenoid, and be positioned between the proximal end of the housing and the solenoid. Responsive to the spring elongating, the locking pin may traverse the solenoid in an opposite direction, and be positioned between a distal end of the housing and the solenoid. In embodiments, the locking pin may be positioned along the shaft such that the locking pin is always positioned within the housing, which may limit snagging or breaking of the locking pin.

The spring may be a device that is configured to compress and elongate, while applying a constant spring force against the shaft. The spring may have a first end that is coupled with the proximal end of the housing, and a second end that is coupled with an upper surface of the shaft. The constant spring force may be in a first direction applied from the proximal end of the housing towards the distal end of the housing, and be applied against the shaft. In embodiments, the constant spring force applied by the spring against the shaft may maintain the wheel in the second mode until an external force is applied against the towable baggage in a second direction that is greater than the spring force. For example, a user may apply a downward force against the towable baggage to create the external force. Responsive to the external force compressing the spring, the locking pin may traverse the solenoid, and lock the wheel within the housing. When the solenoid is locking the locking pin in place, the spring may apply the constant spring force in the first direction. However, the locked solenoid may not enable the spring to elongate. Responsive to unlocking the solenoid, the constant spring force may move the locking pin to be positioned between the solenoid and the distal end of the housing, which may allow the wheel to be positioned outside of the housing. This may enable the wheels to move while the spring is elongated and applying the constant spring force against the shaft, which may give the wheels some shock protection.

The housing may be a device that is configured to hold and secure the elements of the retractable wheel system. The housing may be configured to be embedded within the towable storage system or luggage. The housing may have a distal end that is positioned flush with a lower surface or side surface of the towable storage. A proximal end of the housing may be positioned within the towable storage, and a first end of the spring may be positioned against the proximal end. Between the proximal end and the distal end of the housing may be a chamber, wherein the spring may elongate and compress within the chamber. Based on the elongation and compression of the spring, the shaft and wheel may also move axially within the chamber. The housing may also include a solenoid.

The solenoid may be a device that is configured to selectively lock the locking pin in place. The solenoid may be configured to modify an size of the inner diameter of the chamber to be greater than or smaller than an outer diameter of the locking pin. Furthermore, the solenoid may be a one-way gate that is configured to rotate upward or otherwise increase the inner diameter across the solenoid to allow the locking pin to always move upward. After the locking pin passes the solenoid, the solenoid may automatically decrease the inner diameter across the chamber, which may restrict the downward movement of the locking pin. Responsive to the solenoid becoming unlocked, the solenoid may rotate downward or otherwise increase the inner diameter across the solenoid to allow the locking pin the selectively move downward. After the locking pin passes the solenoid, the solenoid may automatically decrease the inner diameter of the chamber.

Accordingly, the solenoid may be configured to allow for the upward movement of the locking pin, past the solenoid, while selectively locking the locking pin above the solenoid. In embodiments, responsive to receiving an input from the user, the solenoid may be retracted or otherwise increase an inner diameter across the chamber, which may allow the locking pin to move downward past the solenoid. To this end, the solenoid may be a one way gate that is configured freely allow the upward movement of the locking pin, but may be configured to be selectively locked in a plane extending orthogonal to a central axis of the shaft. The solenoid may create a profile on an inner diameter of the housing, which may selectively decrease the inner diameter of the housing. Responsive to the locking pin moving from a distal end of the chamber towards the proximal end of the chamber, the locking pin may apply a force against a lower surface of the solenoid, moving the solenoid upward, and increasing a size across the inner diameter of the chamber. Due to the increase in size across the inner diameter of the chamber, the locking pin may move to a position between the solenoid and the proximal end of the housing. When the locking pin moves past the solenoid, the solenoid may return to the plane extending orthogonal to a central axis of the housing. The locking pin may then rest on an upper surface of the solenoid.

In embodiments, because the solenoid is selectively locked in place, the solenoid may not move downward until desired. To this end, an actuator or mechanical device may apply a force (or remove a force) from the solenoid, allowing the solenoid to swing downward. This may allow the spring to apply a downward force, causing the locking pin to translate this force do the solenoid, allowing the solenoid to swing downward, and move the wheel outside of the housing. Responsive to the external force being applied to wheels, the locking pin may move upward, causing the solenoid to swing upward, and automatically return to its locked position.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
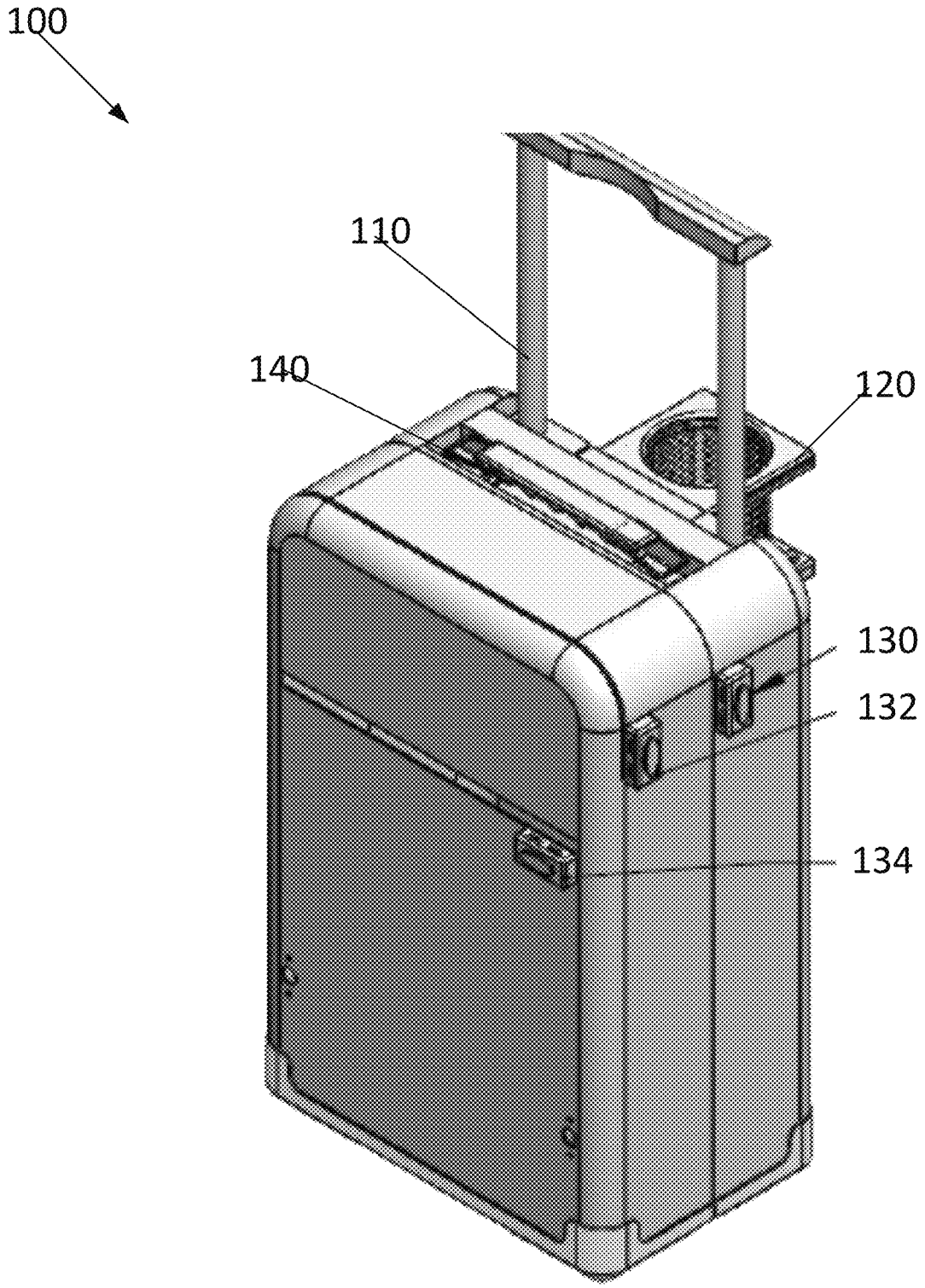
FIG. 1 depicts towable baggage, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present embodiments. It will be apparent, however, to one having ordinary skill in the art that the specific detail need not be employed to practice the present embodiments. In other instances, well-known materials or methods have not been described in detail in order to avoid obscuring the present embodiments.

Embodiments disclosed herein describe systems and methods for a retractable wheel system within towable baggage. The towable baggage may be any type of container, such as luggage, a backpack, etc. that is configured to be moved between locations. The towable baggage may include a plurality of retractable wheel systems, which may be positioned at conventional locations associated with towable baggage. For example, the towable baggage may have retractable wheel systems positioned on a lower surface of the towable baggage.

FIG. 1 depicts towable baggage 100, according to an embodiment. Towable baggage 100 may include a retractable handle 110, collapsible cup holder 120, plurality of locks 130, 132, 132, and recessed handle 110.

Retractable handle 110 may be a handle positioned on an upper surface of towable baggage 100 that is configured to elongate to be positioned outside of towable baggage 100, and retracted to be positioned within towable baggage 100. In embodiments, retractable handle 110 may include a button lock, which may be configured to selectively lock the retractable handle in the retracted position. Responsive to a user pressing the button and applying forces against the retractable handle 110 in an upward direction, the retractable handle 110 may move from the retracted position to the elongated position.

Collapsible cup holder 120 may be a cup holder with a cylindrical top opening that is configured to receive a cup, drink, cylindrical vessel when in a use mode, wherein in the use mode the cylindrical top opening may extend in a direction orthogonal to a central axis of the towable baggage 100. Responsive to a user applying a downward force against the top of the collapsible cup holder 120, the cylindrical top opening may rotate downward, such that the cylindrical top opening is positioned in parallel to the central axis of the towable baggage.

Towable baggage 100 may include a plurality of locks 130, 132, 134 that are configured to secure compartments within towable baggage 100. Locks 130, 132, 134 may be TSA-accepted locks that can be opened by authorities using publically known universal master keys. In embodiments, locks 130, 132, 134 may include an indicator that will appear if opened by the master key. This may enable the owner of towable luggage 100 to know which lock, if any, was opened.

Recessed handle 140 may be a handle positioned on the upper surface of towable baggage 100. Handle 140 may be made of cloth and be configured to extend away from the upper surface. This may be convenient when it is not practical to extend retractable handle 110, such as when loading towable baggage into a vehicle.

Figure 2:
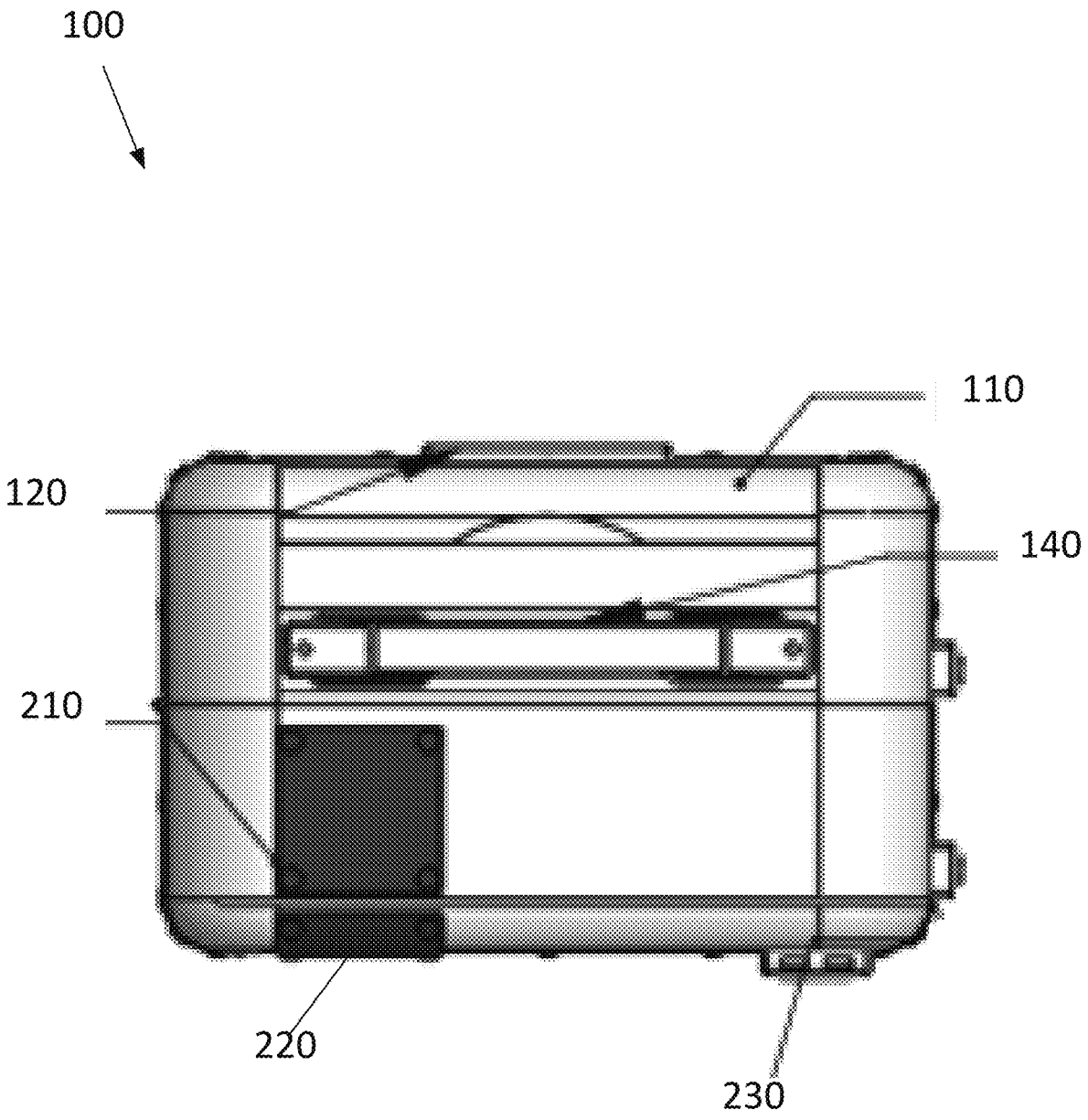
FIG. 2 depicts the upper surface of towable baggage, according to an embodiment.

FIG. 2 depicts the upper surface of towable baggage 100, according to an embodiment. Elements depicted in FIG. 2 may be described above, and for the sake of brevity another description of these elements may be omitted.

As depicted in FIG. 2, when collapsible cup holder 120 is in a storage position, the cylindrical opening may be positioned flush against the rear surface of towable baggage 100 in parallel to a central axis of towable baggage 100. This may reduce the profile of towable baggage.

Furthermore, as depicted, the upper surface of towable baggage 100 may include a top identification tag 210, and a front surface of towable baggage 100 may include a front identification tag 220. Identification tags 210, 220 may include information associated with the user of towable baggage. In embodiments, the identification tags 210, 220 may be customizable and removable identification tags.

Additionally, the front surface of towable baggage 100 may include a front zipper slot 230. Front zipper slot 230 may be utilized to open and close a front compartment of towable baggage 100.

Figure 3:
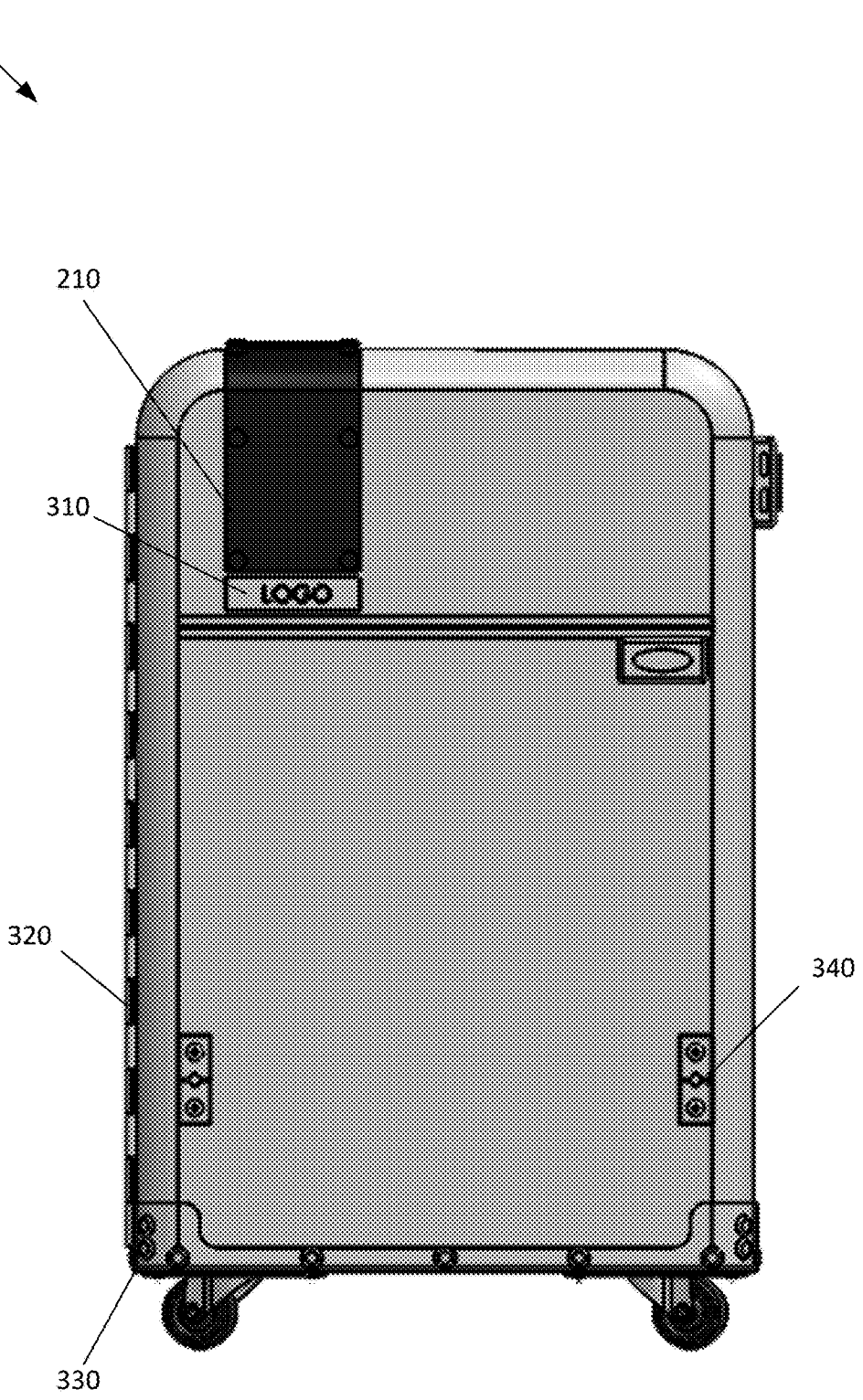
FIG. 3 depicts the front surface of towable baggage, according to an embodiment.

FIG. 3 depicts the front surface of towable baggage 100, according to an embodiment. Elements depicted in FIG. 3 may be described above, and for the sake of brevity another description of these elements may be omitted.

Front surface 310 may also include a logo 310. The logo may be utilized for branding purposes, and also for identification purposes of towable baggage 100. Positioned between front surface 310 and a rear surface may be hinge 320. Hinge 320 may be configured to allow front surface 310 to be rotated away from the rear surface to expose a central compartment within towable baggage.

Front surface 310 may also include a plurality of rivets 330, which are configured to secure a wheel housing of towable luggage 100.

Front surface 310 may also include a manual unlock assembly 340. The manual unlock assembly may be configured to receive external forces from a user to move an actuator between a locked to unlock position, wherein in the locked position the wheels may be maintained within towable baggage 100, and when the actuator is in the unlocked position the wheels may automatically extend to a position outside of towable baggage 100.

Figure 4:
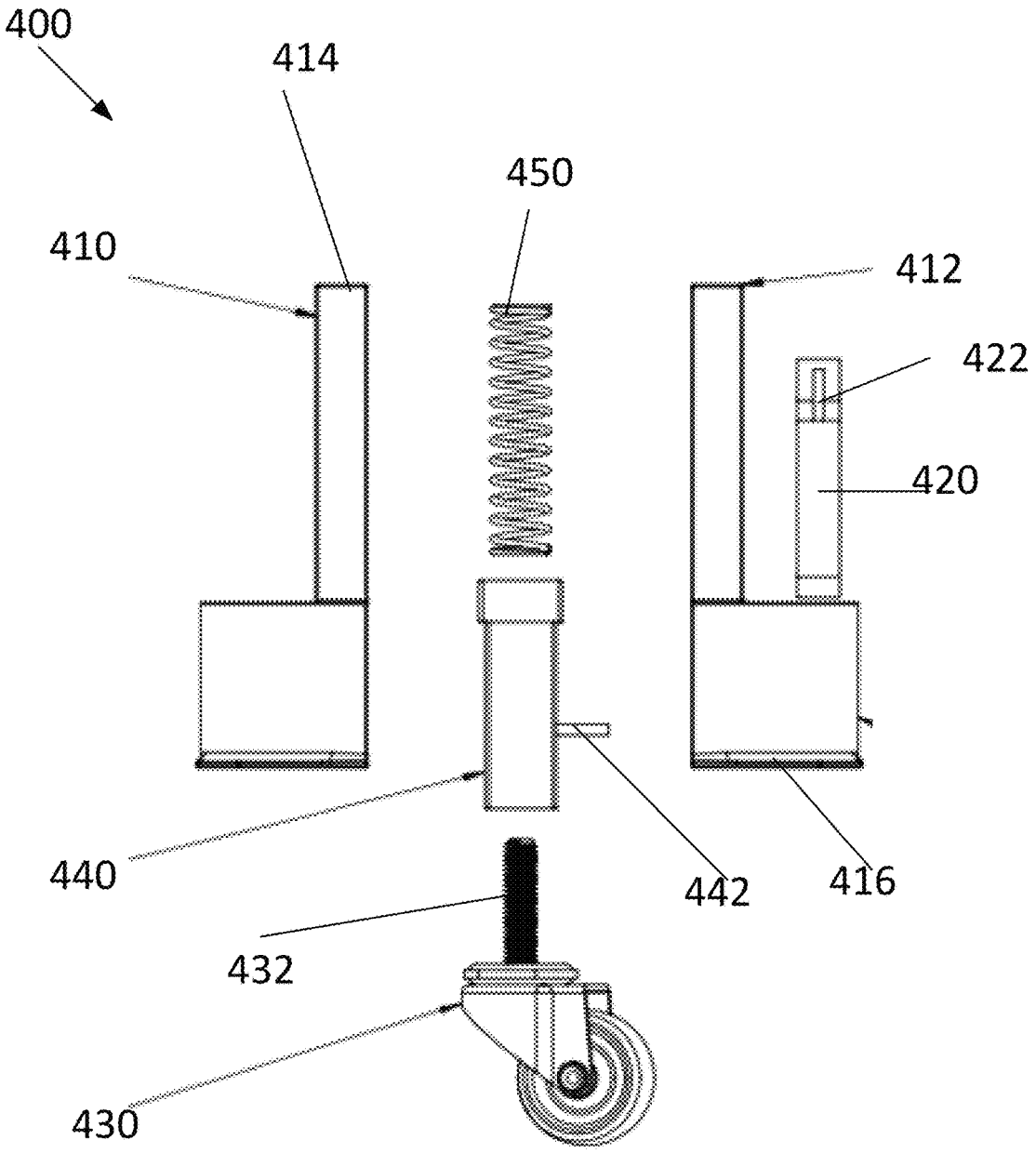
FIG. 4 depicts a retractable wheel system, according to an embodiment.

FIG. 4 depicts a retractable wheel system 400, according to an embodiment. Retractable wheel system 400 may be positioned on a lower surface of towable baggage 100, wherein towable baggage 100 may have a plurality of retractable wheel systems 400. For example, a piece of luggage may have four retractable wheels systems 400 that are each independently controlled. Retractable wheel system 400 may be configured to allow wheels to freely rotate outside of retractable wheel systems 400, and when desirable allow a user to perform actions to lock the wheels within retractable wheel system 400. Each retractable wheel system 400 may include a wheel 430, a shaft 440, spring 450, housing 410, and actuator 420.

Wheel 430 may be a castor that is configured to enable an object, such as towable baggage 100 to be moved. Wheel 430 may be formed of various materials, shapes, and sizes. In a first mode (use mode) of operation, Wheel 430 may be configured to be positioned outside of the housing 410, 412, and in a second mode (storage mode) of operation, wheel 430 may be configured to be positioned in the housing 410, 412. Wheel 430 may include a threaded tube 432, which is configured to be coupled with an inner circumference of the shaft 440. In embodiments, responsive to the shaft 440 moving along a linear axis, wheel 430 may move along the linear axis. This may enable wheel 430 to be positioned outside of the housing 410, 412 in the first mode, and inside of the housing 410, 412 in the second mode.

The shaft 440 may be tube, cylinder, projection, etc. having a first end coupled to the wheel 430, and a second end positioned directed adjacent to spring 450. Shaft 440 may be configured to translate forces applied by the spring 450 to the wheel 430, which may enable the wheel 430 to move from the first mode to a second mode. Shaft 440 may include a locking pin 442. Locking pin 442 may be a projection, outcrop, protrusion, etc. that is fixed on an outer circumference of the shaft 440, wherein locking pin 442 may be configured to extend in a plane orthogonal to a central axis of the shaft 440. Locking pin 442 may have a fixed outer diameter that is greater in size than the outer diameter of shaft 440. In embodiments, locking pin 442 may be configured to selectively secure wheel 430. Specifically, when locking pin 442 is secured within housing 410, 412 via a gate, wheel 430 may be positioned within housing 410, 412. When the movement of locking pin 442 is no longer restricted by the gate, wheel 430 may be positioned outside of the housing 410, 412.

Spring 450 may be a device that is configured to compress and elongate, while applying a constant spring force, wherein the constant spring force may be in a downward direction towards shaft 440, which may be orthogonal to the central axis of locking pin 442. Spring 450 may have a first end that is coupled with the proximal end 414 of housing 410, 412, and a second end that is coupled with the distal end 416 of housing 410, 412. In embodiments, the constant spring force applied by the spring 450 against the shaft may maintain the wheel 430 in the second mode until an external force is applied against the towable baggage 100 and spring 450 in a second direction that is greater than the spring force. For example, a user may apply a downward force against the upper surface of towable baggage 100 to create the external force. Responsive to the external force compressing the spring 450, the locking pin 442 may traverse the gate or solenoid (not shown), and the gate or solenoid may lock the wheel 430 within the housing 410, 412. In embodiments, responsive to the spring 450 compressing a vertical offset between the locking pin 442 and a proximal end 414 of the housing 410, 412 may decrease. This may enable the locking pin 442 to traverse the solenoid, and be positioned between the proximal end 414 of the housing 410, 412 and the solenoid along the central axis of retractable wheel system 400. When the solenoid is locking the locking pin 442 in place, the spring 450 may apply the constant spring force in the first direction. However, the locked solenoid may not enable the spring 450 to elongate. Responsive to the spring 450 elongating, the locking pin 442 may traverse the solenoid in an opposite direction, and be positioned between a distal end 414 of the housing 410, 420 and the solenoid. In other words, when the solenoid is unlocked, the constant spring force may move the locking pin 442 to be positioned between the solenoid and the distal end 416 of the housing 410, 412, which may allow the wheel 430 to be positioned outside of the housing 410, 412. When the wheels 430 are positioned outside of housing 410, 420, the towable baggage 100 may be rolled while the spring 450 is elongated and applying the constant spring force against the shaft 440, which may give the wheels 430 some shock protection.

Housing 410, 412 may be a device that is configured to hold and secure the elements of the retractable wheel system 400. The housing may be configured to be embedded within the towable storage system 100 or luggage. Housing 410, 412 may have a distal end 416 that is positioned flush with a lower surface or side surface of the towable baggage 100. Housing 410, 412 may also include a proximal end 414 positioned within the towable baggage 100, and a first end of the spring 450 may be positioned against the proximal end 414. Between the proximal end 414 and the distal end 416 of the housing 410, 412 may be a chamber (shown in FIG. 5), wherein the spring 450 may elongate and compress within the chamber. Based on the elongation and compression of the spring 450, shaft 440 and wheel 430 may also move axially within the chamber. To control the elongation and compression of spring 450, housing 410, 412 may include a solenoid.

The gate or solenoid may be a device that is configured to selectively lock the locking pin 442 in place. Generally, the gate or solenoid may be any mechanical device that is configured to selectively change an inner diameter across the chamber. When the inner diameter across the chamber is larger than an outer diameter associated with the locking pin 442, spring 450 may compress or elongate. However, when the inner diameter across the chamber is smaller than the outer diameter associated with locking pin 442, spring 450 may not transition between a compressed an elongated state.

In embodiments, the gate or solenoid may be configured to allow for the upward movement of locking pin 442, past the gate or solenoid, while selectively locking the locking pin 442 above the gate or solenoid. This may allow for spring 450 to freely compress, while selectively restricting the elongation of spring 450.

In embodiments, responsive to receiving an input from the user, the gate or solenoid may be retracted or otherwise increase an inner diameter across the chamber. This may allow the locking pin 442 to move downward past the solenoid. To this end, the gate or solenoid may be a one way gate that is configured freely allow the upward movement of the locking pin 442, wherein forces applied by locking pin 442 against the gate or solenoid may cause the inner diameter across the solenoid to increase. However, the gate or solenoid may not freely rotate when downward forces are applied to the upper surface of the solenoid by the locking pin 442. Accordingly, the gate or solenoid may be configured to be selectively locked in a plane extending orthogonal to a central axis of the shaft 440, with the solenoid creating an inner diameter across the chamber to be smaller than the outer diameter associated with locking pin 442.

Responsive to the locking pin 442 moving from distal end 416 of the chamber towards the proximal end 414 of the chamber, locking pin 442 may apply a force against a lower surface of the solenoid, moving the solenoid upward, and increasing a size across the inner diameter of the chamber. Due to the increase in size across the inner diameter of the chamber, locking pin 442 may move to a position between the gate or solenoid and the proximal end 414 of the housing 410, 412. When locking pin 442 moves upward past the gate or solenoid, the gate or solenoid may automatically return to the plane extending orthogonal to a central axis of the housing. However, because the gate or solenoid cannot freely rotate downward, locking pin 442 may then rest on an upper surface of the gate or solenoid. In embodiments, because the gate or solenoid is selectively locked in place, the gate or solenoid may not move downward until desired. To this end, an actuator or mechanical device may apply a force (or remove a force) from the gate or solenoid, allowing the gate or solenoid to swing downward or otherwise reduce an inner diameter across the chamber. This may allow the spring 450 to apply a downward force, causing locking pin 442 to translate this force do the gate or solenoid, allowing the gate or solenoid to swing downward or increase an inner diameter across the chamber, and allowing the wheel 430 to move outside of the housing. Responsive to the external force being applied to wheels 430, locking pin 442 may move upward, causing the solenoid to swing upward or otherwise increase the inner diameter across the chamber, and automatically return to its locked position extending in a direction orthogonal to shaft 440 and having an inner diameter that is smaller than the outer diameter of locking pin 442.

In embodiments, the gate or solenoid may be selectively unlocked, allowing spring 450 to transition from a compressed state to an elongated state based on a user interacting with towable baggage 100. The user's interaction may be to press a button, such as button 422, to mechanically release the gate or solenoid, allowing the gate or solenoid to rotate downward or retract. Alternatively, button 422 may be utilized to remove an electric charge associated with the gate or solenoid, which may allow the gate or solenoid to rotate downward or retract, and once button 422 is no longer pressed, then the solenoid may automatically rotate or move back to its locked position.

Figure 5:
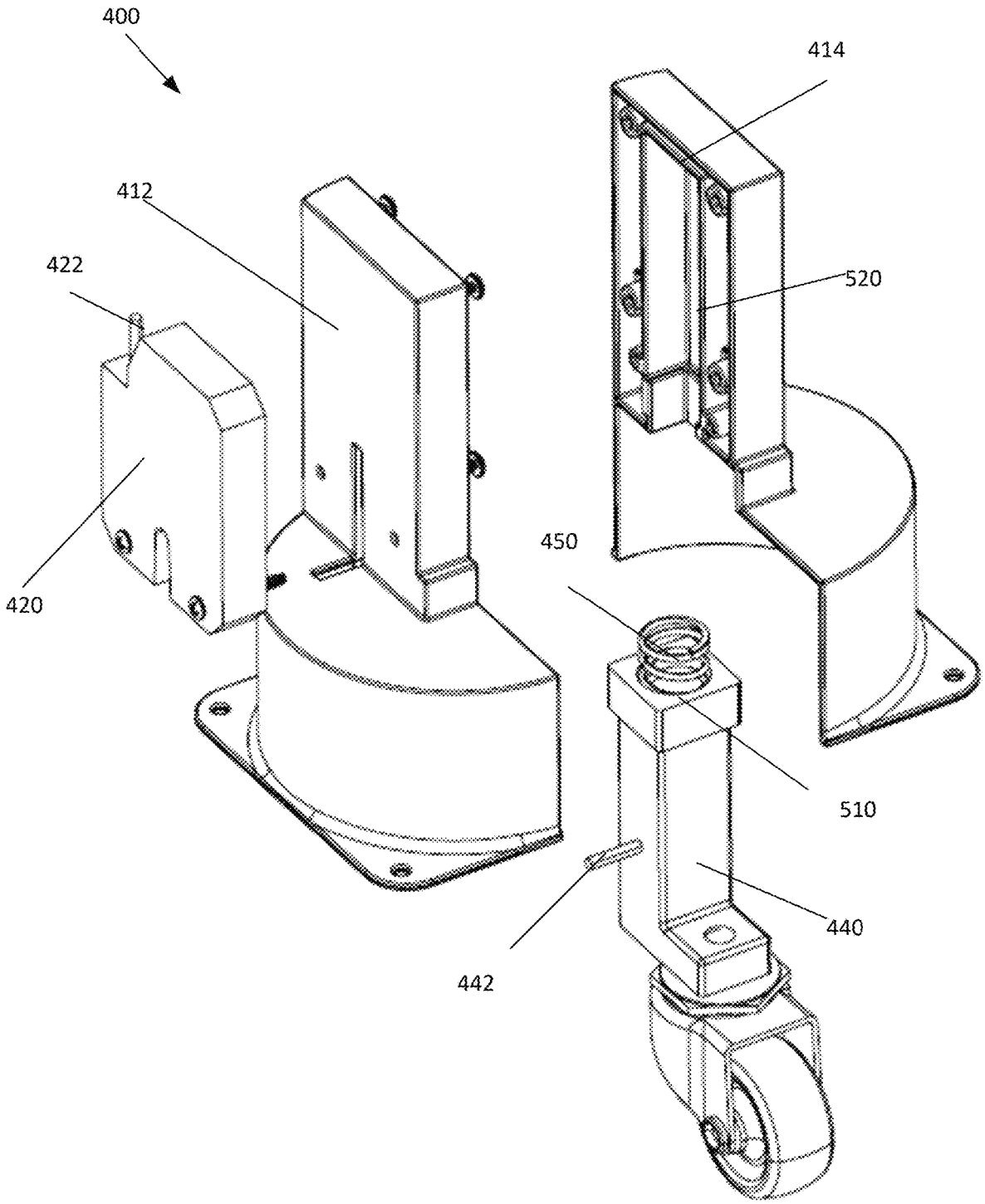
FIG. 5 depicts a retractable wheel system, according to an embodiment.

FIG. 5 depicts a retractable wheel system 400, according to an embodiment. Elements depicted in FIG. 5 may be described above, and for the sake of brevity another description of these elements may be omitted.

As depicted in FIG. 5, spring 450 may be positioned within a chamber 520 of the housing. Spring 450 may have a first end permanently positioned against proximal end 414 at a fixed location. A second end of spring 450 may be configured to be positioned within a recess 510 on a proximal end of shaft 440. Responsive to spring 450 elongating or compressing, a distance between the first and second ends of spring 450 may change.

Figure 6:
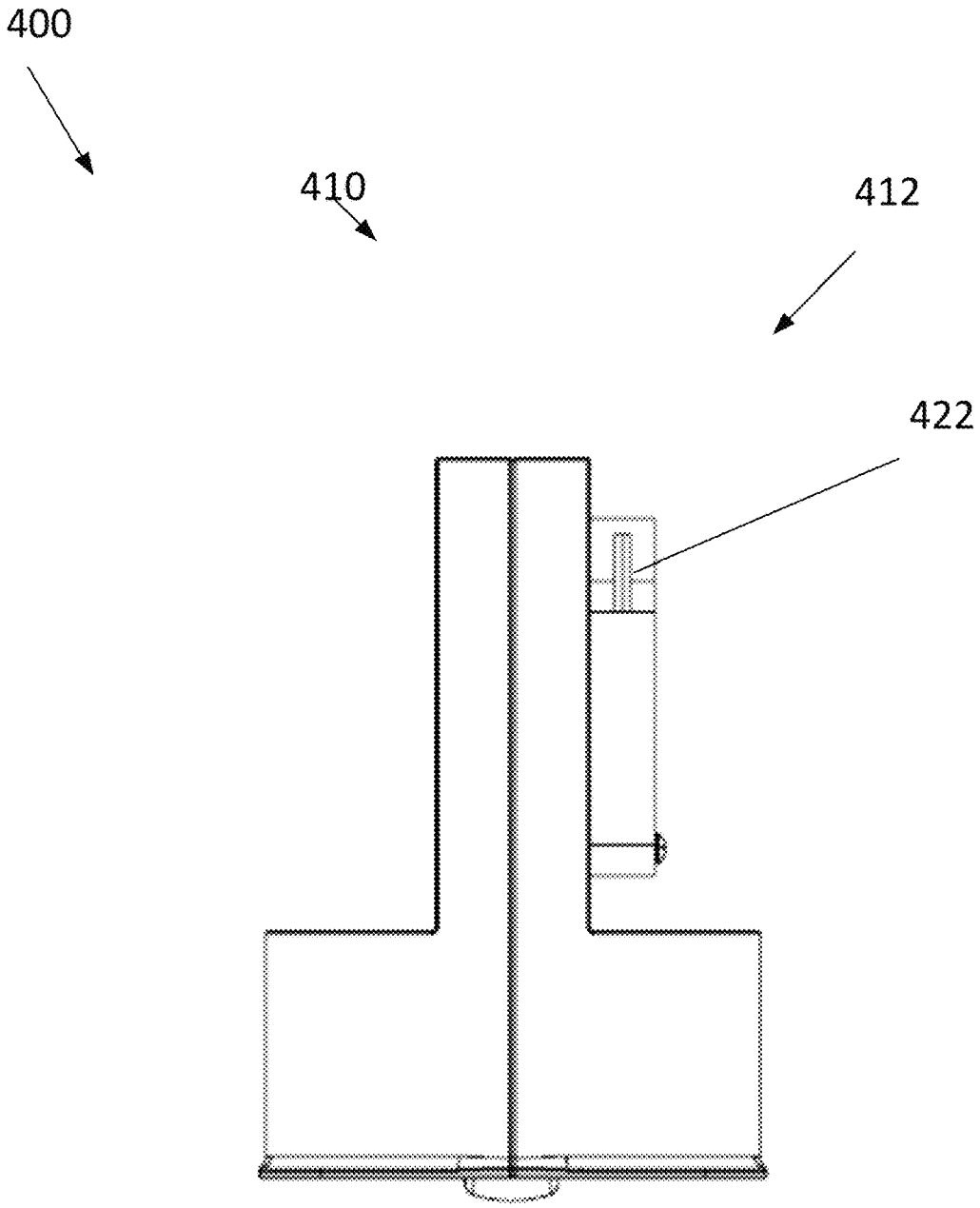
FIG. 6 depicts a side view of a retractable wheel system, according to an embodiment.

FIG. 6 depicts a side view of retractable wheel system 400, according to an embodiment. Elements depicted in FIG. 6 may be described above, and for the sake of brevity another description of these elements may be omitted.

Figure 7:
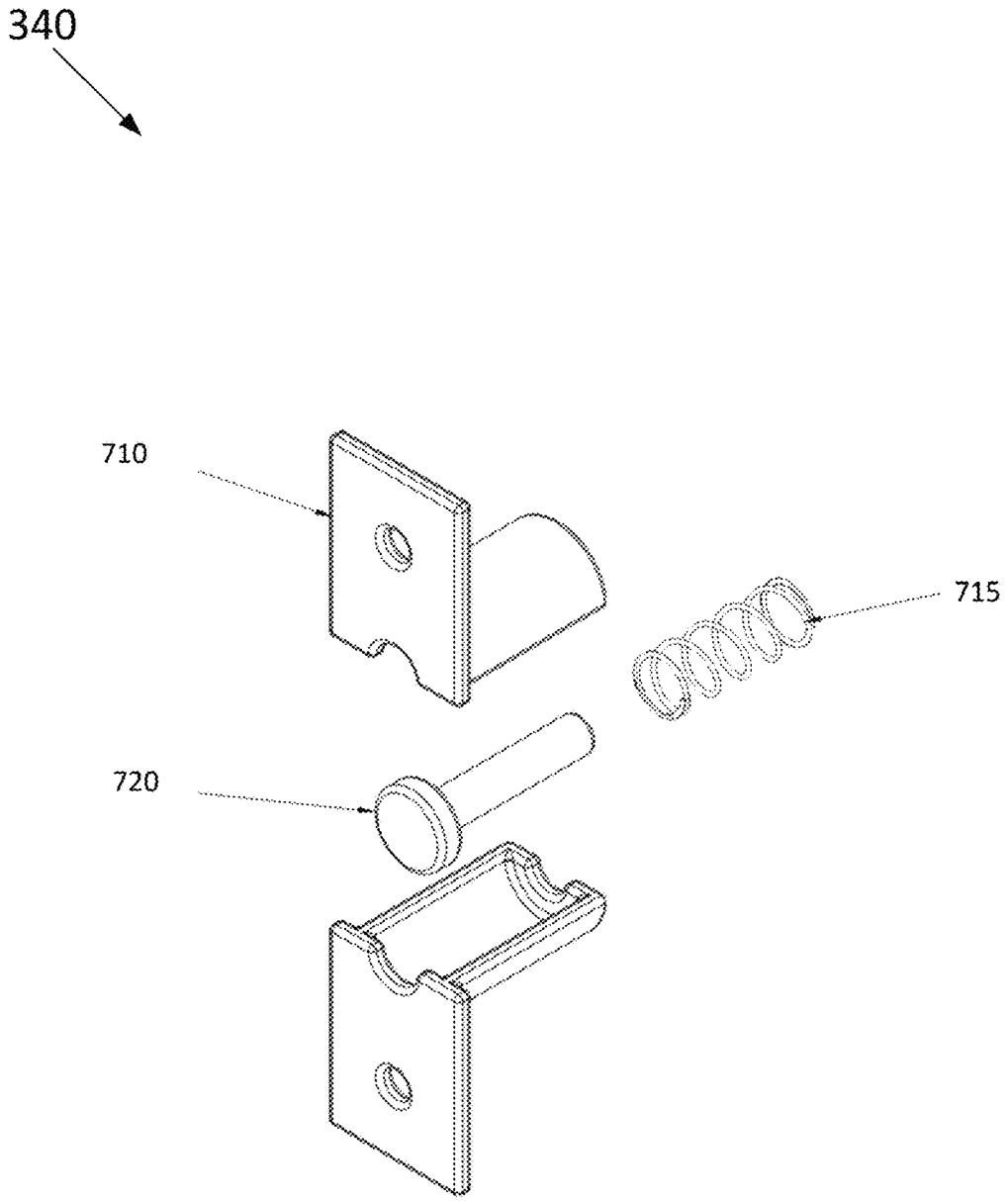
FIG. 7 depicts a side view of manual unlock assembly, according to an embodiment.

FIG. 7 depicts a side view of manual unlock assembly 340, according to an embodiment. Elements depicted in FIG. 7 may be described above, and for the sake of brevity another description of these elements may be omitted.

In embodiments, each retractable wheel assembly may include a manual unlock assembly 340, wherein a corresponding manual unlock assembly 340 may be configured to manually unlock a solenoid. This may allow the locking pin 420 to no longer be positioned on the gate or solenoid and allow the spring 450 to elongate. Unlock assembly 340 may include a base 710, spring 715, and button 720.

The base 710 may be configured to be positioned flush on a front or rear surface of the towable baggage. Spring 715 may be configured to elongate and compress to allow a front face of button 720 to be naturally positioned substantially flush with a front face of base 710. Responsive to a user pressuring button 720 inward, spring 715 may compress allowing an inner surface of button 720 to interact with the gate or solenoid to unlock the gate or solenoid. Responsive to the user no longer pressing the button, spring 715 may push button outward.

To this end, the gate or solenoid may be manually or electronically locked in place.

Figure 8:
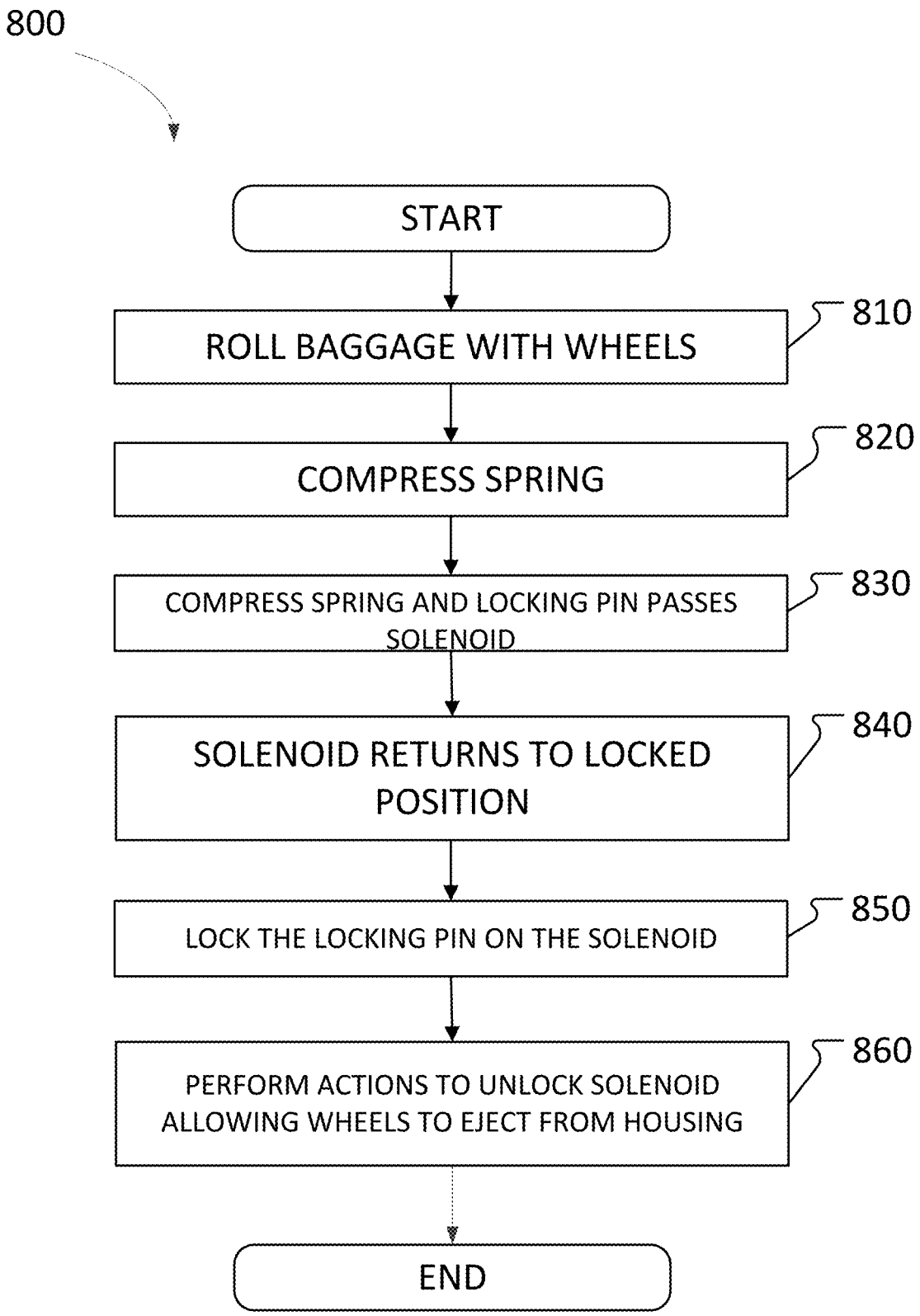
FIG. 8 illustrates a method for retractable wheels in towable baggage.

FIG. 8 illustrates a method 800 for retractable wheels in towable baggage. The operations of method 800 presented below are intended to be illustrative. In some embodiments, method 800 may be accomplished with one or more additional operations not described, and/or without one or more of the operations discussed. Additionally, the order in which the operations of method 800 are illustrated in FIG. 8 and described below is not intended to be limiting.

At operation 810, wheels may be extended from a housing, and allow baggage to be rolled. When the wheels are extended, a spring within a housing may be able to slightly compress and elongate within locking the wheels within the housing.

At operation 820, a user may perform actions the towable baggage to compress the spring. For example, a user may push down on an upper surface of the towable baggage.

At operation 830, due to the spring compressing a locking pin may traverse a gate or solenoid, wherein the gate or solenoid may have a smaller inner diameter than that of the locking pin when the locking pin is crossing the gate or solenoid. In embodiments, the locking pin may physically touch and move the solenoid to change an inner diameter across the solenoid. For example, the gate or solenoid may be a one way hinge that can freely rotate in an upward angle.

At operation 830, once the locking pin passes the gate or solenoid, the gate or solenoid may automatically revert back to a locked position, and extended in a direction orthogonal to a central axis of the spring. When in the locked position, the inner diameter across the gate or solenoid may be smaller than that of the locking pin.

At operation 850, the user may no longer apply force against the upper surface of the towable baggage, and the spring may partially elongate. The spring may elongate a distance until a lower surface of the locking pin is positioned against the locked solenoid, wherein the locked solenoid may secure the wheel within the housing.

At operation 860, the user may perform actions to unlock the gate or solenoid. For example, the user may press a button to mechanically unlock the solenoid, or press a button to electronically unlock the gate or solenoid. When the gate or solenoid is unlocked, a force created by the locking pin against the upper surface of the gate or solenoid may cause the solenoid to have a larger inner diameter than that of the outer diameter of the locking pin. This may allow the locking pin to be moved downward due to the force of the spring, and the wheels to be positioned outside of the housing.

As such, systems described herein allow for wheels to be retracted within a housing responsive to a user performing actions on a user interface and simultaneously providing a compressive force against a spring. Responsive to the user performing further actions on the user interface, the wheels may automatically become extended.

Figure 9:
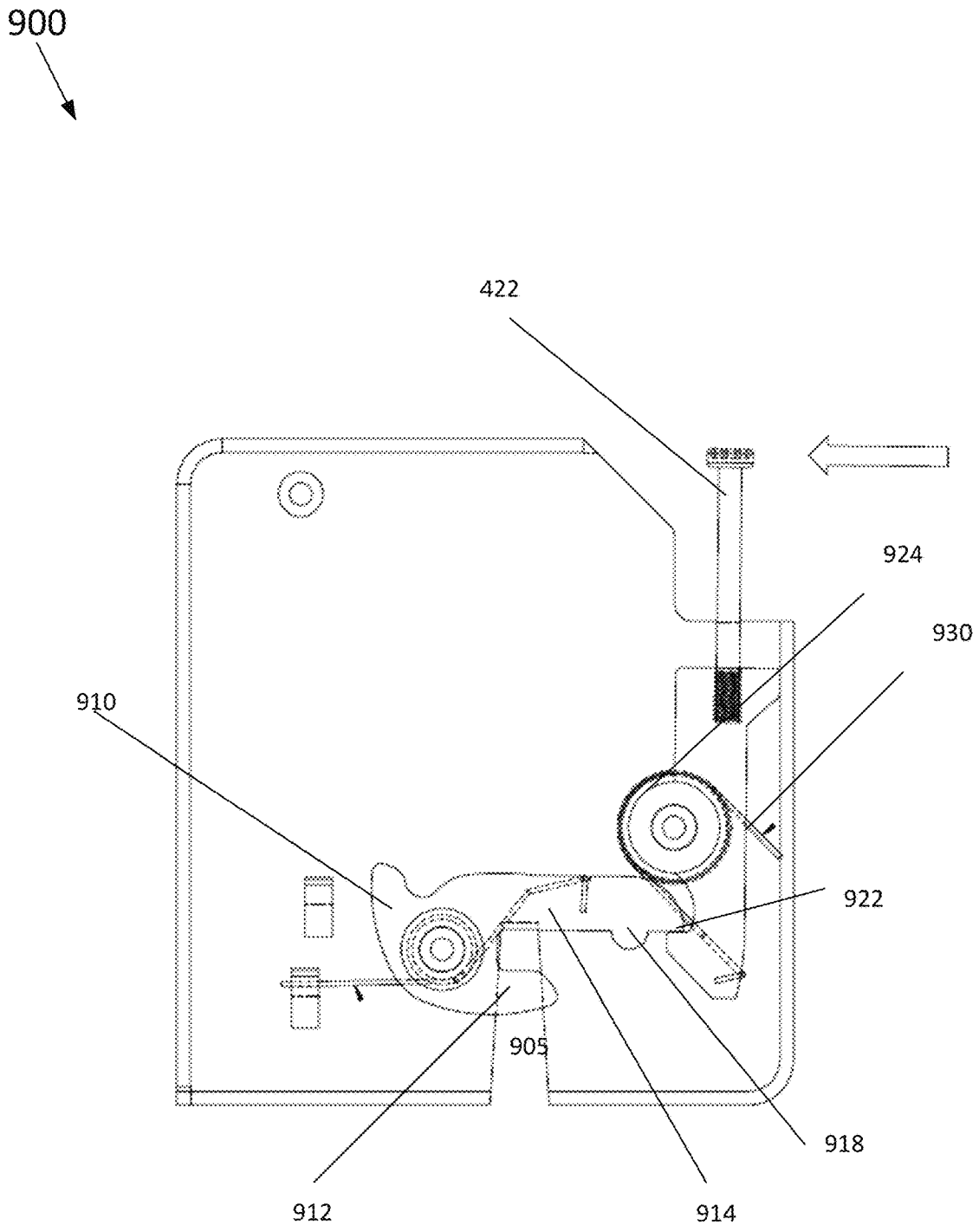
FIG. 9 depicts an embodiment of a solenoid or locking system in the locked position, wherein locking system is configured to allow the selective movement of the locking pin.

FIG. 9 depicts an embodiment of a solenoid or locking system 900 in the locked position, wherein locking system 900 is configured to allow the selective movement of the locking pin. Locking system 900 may include gate 910, lock 920, button 422, and a solenoid.

Gate 910 may be configured to rotate upwards responsive to receiving a force, and be selectively locked in place on lock 920. Gate 910 may also be configured to selectively rotate downward responsive to moving lock 920. Gate 910 may include a first arm 912, second arm 914, and channel 916. First arm 912 may have a first length, which is shorter than a second length of second arm 912. First arm 912 may be configured to extend across a slot 905 within the housing when in the locked position, and not extend across the slot 905 when in the unlocked position. When in the locked position, a locking pin 442 may be configured to be positioned on an upper surface of first arm 912, within channel 916, and within slot 905.

Second arm 916 may have a length that is always configured to extend across slot 905, which may limit the upward movement of locking pin 442. When in the locked position, a profile 918 of the distal end of arm 916 may rest on a ledge 922 on lock 920. The interfacing of profile 918 and ledge 922 may limit the downward movement of second arm 916, which may maintain gate 910 in the locked position until an external force is applied against button 422. Furthermore, when in the locked position, the upward movement of second arm 916 may be restricted due to a profile on the inner diameter of lock 924.

Lock 920 may be configured to selectively secure second arm 920 extending across slot 905, which may maintain locking pin 442 and the wheels within the housing. When in the locked position, lock 920 may extend in a direction perpendicular to an axis of second arm 916. Lock 920 may be configured to rotate to slide ledge 922 away from profile 918. Specifically, shaft 931 may pull button 422 to move ledge 922. This may allow second arm 914 to rotate downward. When second arm 914 rotates downward, first arm 912 may no longer extend across slot 905, allowing a spring within a housing to apply a downward force against locking pin 442. The downward force created by the spring may be applied to first arm 912, forcing the downward rotation of second arm 914. Subsequently, shaft 931 nay push button 422 to move first arm 912 across slot 905 to lock the locking pin 422 in place.

Button 422 may be positioned on an upper surface of lock 420. Button 422 may be a shaft that is configured to receive forces from the solenoid to release lock 420, allowing ledge 922 to move away from profile 918. Specifically, button 422 may be configured to receive a force from the solenoid to maintain in parallel to a central axis of slot 905. This may allow ledge 922 to be positioned under profile 918, and maintain gate 910 in the locked position. When the solenoid applies a force, or removes a force, button 422 may move ledge 922 away from slot 905, allowing gate 910 to automatically swing downward. Responsive to the solenoid reapplying the force directly against button 422, button 422 may automatically move ledge 922 towards the central axis of slot 905, such that button 422 is normally positioned closer to the central axis of slot 905 and only moves away from slot responsive to the solenoid performing actions to pull button 422 inward towards a plane aligned with the central axis of slot 905, within the housing. In other embodiments, button 422 may directly receive forces from a user to move lock 920 from a position where ledge 922 is under profile 918 to a position where ledge 922 is pulled away from profile 918.

The solenoid may be an electronic device that is configured to apply forces or remove forces against button 422. In embodiments, responsive to the solenoid receiving an electric command, the solenoid may be configured to perform actions such that a shaft 931 directly coupled to button 422 pulls button 422 inward. Accordingly, shaft 931 may pull button 422 towards a central axis of the housing, which may allow gate 910 to move from a locked position to an unlocked position. Responsive to the solenoid no longer performing actions to pull button 422, a spring may apply a force directly against button 422 to rotate ledge 922 towards the central axis of the housing. This may allow the spring to maintain ledge 922 under profile 918 after the locking pin moves gate 910 to the locked position, wherein ledge 922 may remain under profile 918 until the solenoid creates a force to move shaft 931 and button 422 towards the central axis of housing. This inward movement of button 422 may move ledge 922 outward, allowing gate 910 to become unlocked.

Figure 10:
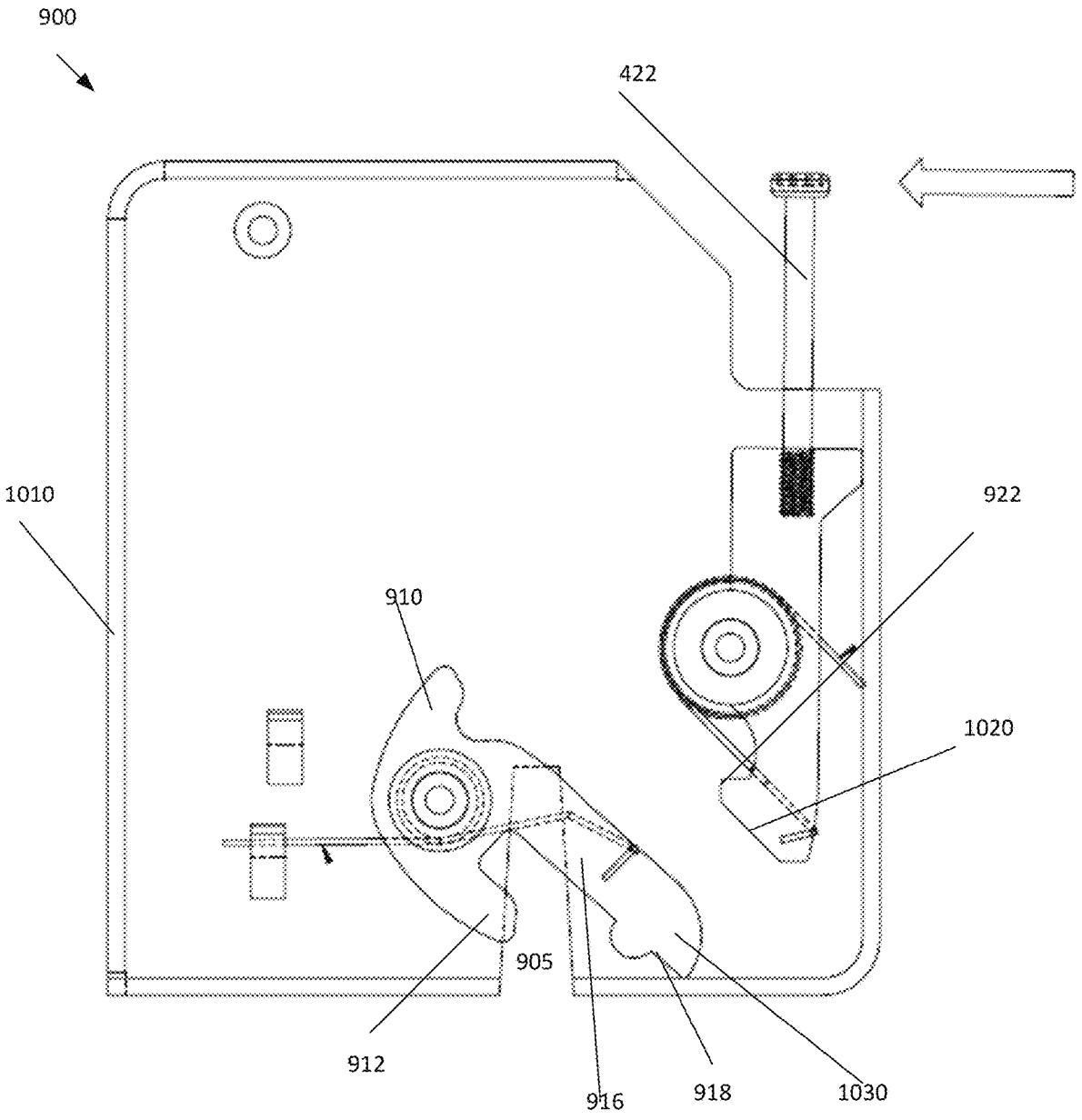
FIG. 10 depicts an embodiment of a solenoid or locking system in the unlocked position, wherein locking system is configured to allow the selective movement of the locking pin.

FIG. 10 depicts an embodiment of a solenoid or locking system 900 in the unlocked position, wherein locking system 900 is configured to allow the selective movement of the locking pin.

As depicted in FIG. 10, when ledge 922 is no longer under profile 918, gate 910 may automatically swing downward, and profile 918 may be positioned adjacent to a lower surface of housing 1010. When gate 910 swings downward, second arm 914 may be positioned at a downward angle across slot 905 and first arm 912 may be positioned at a downward angle but end before slot 905. This may enable a lower surface of second arm 914 to receive an upward force from a locking pin 442 to move gate 910 from an unlocked position to a locked position.

Specifically, when the locking pin 442 applies an upward force against gate 910, a tapered outer profile 1030 of gate 910 may interface with a tapered inner profile of lock 1020. This may once again lock the locking pin 442 within slot 905 by outwardly moving ledge 922 until profile 918 is positioned above ledge 922. Due to the reduction in length across ledge 922, and the forces against button 422 to inwardly move ledge 922, responsive to positioning profile 918 above ledge 922, ledge 922 may automatically move inward, which may lock gate 910 in place.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

What is claimed is:

1. A system for retractable wheels for luggage comprising:

a locking pin coupled to a wheel assembly for a wheel, wherein the locking pin is configured to move vertically along a linear axis within a slot;

a gate with a first arm and a second arm, the first arm having a first length, and the second arm having a second length, the first length being shorter than the second length, wherein the locking pin is configured to be positioned between the first arm and the second arm within the slot when the wheel assembly is locked and the locking pin is configured to be positioned below the first arm when the wheel assembly is unlocked.

2. The system of claim 1, wherein when the wheel assembly is locked the first arm extends across the slot, and when the wheel assembly is unlocked the first arm does not cover the slot.

3. The system of claim 1, further comprising:

a lock with a ledge, the ledge being configured to be positioned under a distal end of the second arm when the wheel assembly is locked, and the ledge being positioned away from the distal end of the second arm when the wheel assembly is unlocked.

4. The system of claim 3, wherein an upper end of the lock includes a button, the button being configured to be pulled to move the ledge away from the distal end of the second arm to transition to wheel assembly from being locked to unlocked.

5. The system of claim 1, wherein the second arm extends in a direction orthogonal to a central axis of the slot when the wheel assembly is locked, and the second arm extends at a downward angle when the wheel assembly is unlocked.

6. The system of claim 1, wherein the wheel assembly includes a housing and a spring, the spring being configured to apply a constant downward spring force, wherein the constant downward spring force automatically moves the locking pin downward when the first arm is not extending across the slot.

7. The system of claim 6, wherein when a user applies an external force opposite the constant downward spring force to move the wheel assembly from the unlocked position to the locked position.

8. The system of claim 7, wherein when the user applies the external force the locking pin moves vertically along the linear axis within the slot to move the second arm of the gate upward.

9. The system of claim 1, further comprising:

a suitcase being configured to house the wheel assembly, wherein the suitcase includes four independently operating wheel assemblies.

10. The system of claim 9, further comprising:

a cupholder positioned on a rear surface of the suitcase.

* * * * *